US011124334B2

(12) United States Patent
Hopf et al.

(10) Patent No.: US 11,124,334 B2
(45) Date of Patent: Sep. 21, 2021

(54) DISCHARGE CAP FOR A CONTAINER

(71) Applicant: Hans-Juergen Hopf, Zirndorf (DE)

(72) Inventors: Hans-Juergen Hopf, Zirdorf (DE); Michael Hopf, Zirndorf (DE); Norbert Kassai, Oberasbach (DE)

(73) Assignee: HANS-JUERGEN HOPF, Zirndorf (DE)

( * ) Notice: Subject to any disclaimer, the term of this patent is extended or adjusted under 35 U.S.C. 154(b) by 58 days.

(21) Appl. No.: 16/608,902

(22) PCT Filed: Mar. 22, 2018

(86) PCT No.: PCT/EP2018/057266
§ 371 (c)(1),
(2) Date: Oct. 28, 2019

(87) PCT Pub. No.: WO2018/197117
PCT Pub. Date: Nov. 1, 2018

(65) Prior Publication Data

US 2020/0198845 A1 Jun. 25, 2020

(30) Foreign Application Priority Data

Apr. 27, 2017 (DE) ..... 102017109108.4

(51) Int. Cl.
*B65D 41/50* (2006.01)
*A61J 1/14* (2006.01)
*B65D 51/22* (2006.01)

(52) U.S. Cl.
CPC ..... *B65D 41/50* (2013.01); *A61J 1/1418* (2015.05); *A61J 1/1487* (2015.05); *B65D 51/22* (2013.01); *B65D 2547/063* (2013.01)

(58) Field of Classification Search
CPC ..... B65D 41/50; B65D 41/32; B65D 51/22; B65D 51/226; B65D 51/221;
(Continued)

(56) References Cited

U.S. PATENT DOCUMENTS 8,714,380 B2 * 5/2014 Casale ..... B65D 5/029 215/297
9,925,120 B2 3/2018 Kropezynski et al.
(Continued)

FOREIGN PATENT DOCUMENTS

FR 2647089 A1 * 11/1990 ..... B65D 51/226

*Primary Examiner* — Robert J Hicks
(74) *Attorney, Agent, or Firm* — Douglas Denninger

(57) ABSTRACT

Discharge cap, in particular for a container for accommodating an enteral nutritional solution. The container has a discharge opening, which is sealed liquid-tight with a cover and has a projection for the arrangement of the discharge cap in the region of the discharge opening. The discharge cap can be arranged with an open front end over the discharge opening of the container and has at least one receiving opening for a discharge tap on the opposite side of the side of the discharge cap facing away from the open front end. At least one sealing body is arranged in the region of the open front end of the discharge cap. A tear-open aid is arranged below the receiving opening and in the region of the open front end, wherein the tear-open aid is moved in the direction of the open front end during insertion of the discharge tap.

13 Claims, 5 Drawing Sheets

Figure 1:
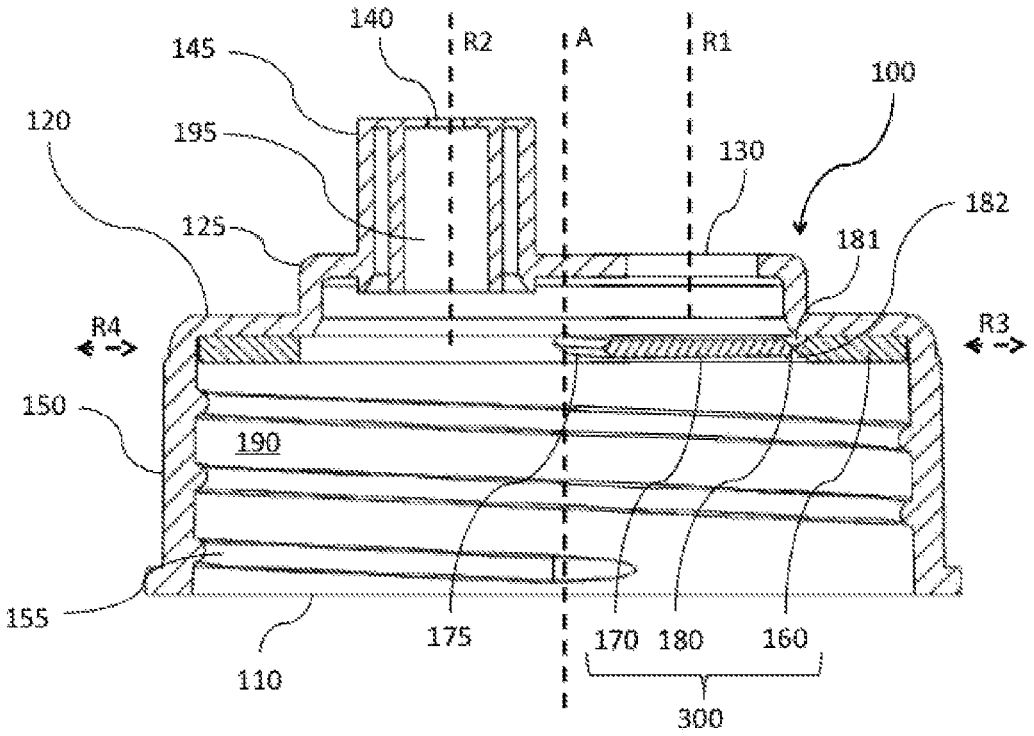

(58) Field of Classification Search
CPC ..... B65D 51/1661; B65D 51/1633; B65D 51/16; B65D 47/12; B65D 47/122; B65D 25/48; B65D 25/40; A61J 1/1418; A61J 1/1412; A61J 1/14; A61J 1/1487; A61J 1/1475
USPC ..... 215/297, 296, 295, 307; 220/278, 277, 220/265, 367.1; 222/568, 567, 566, 544
See application file for complete search history.

(56) References Cited

U.S. PATENT DOCUMENTS

| | | | | |
|---|---|---|---|---|
| 2006/0261028 | A1* | 11/2006 | Dubach | B65D 5/748 215/257 |
| 2011/0309047 | A1 | 12/2011 | Fucito | |
| 2015/0290081 | A1* | 10/2015 | Kropczynski | B65D 51/226 604/244 |
| 2018/0296438 | A1 | 10/2018 | Brandenburger et al. | |

* cited by examiner

DISCHARGE CAP FOR A CONTAINER

The invention relates to a cap, in particular a discharge cap for a container for receiving an enteral nutritional solution.

In certain mentally or physically ill patients who are unable to eat food on their own, in particular in hospitals, an artificial feeding often needs to be performed to meet their daily calorie needs. Nutritional solutions are usually administered by artificial feeding, the nutritional solutions being nutritionally balanced, that is, containing all the important nutrients (for example, carbohydrates, fats, proteins, vitamins, trace elements, minerals, and water or similar) in the ratio required by the body.

The artificial feeding thus replaces some natural nutritional steps of the body and is subdivided into two types, depending on the mode of administration: parenteral feeding, which takes place by infusing the nutrients directly into the bloodstream, and enteral feeding, which takes place directly through the gastrointestinal tract. When possible, it is particularly preferable to perform a long-term artificial feeding by enteral feeding, since enteral feeding is closer to physiological feeding.

The infusion during parenteral feeding is liquid and is intravenous, usually performed directly to a vein through a venous catheter. The nutrients, however, which are introduced into the body by the enteral feeding often have an increased viscosity. This often impedes the discharge of food from a container and can also lead to sedimentation of the nutritional solution in the container.

Containers for accommodating an enteral nutritional solution are, for example, vessels and/or bags and/or bottles of any type or shape which are suitable for accommodating an enteral nutritional solution. In particular, such containers have at least one discharge opening through which the contents of the container can exit. In particular, the dimensions and/or the characteristics of the discharge opening are determined, among other things, by the standard DIN 18250-3, possibly in conjunction with DIN 80369-3.

The containers for accommodating an enteral nutritional solution must be sterilized before the nutritional solution is filled, since the nutritional solution must not be contaminated during its filling. The nutritional solution must continue to be kept sterile after filling, which is ensured by an air and liquid-tight cover of the discharge opening. For example, the cover is a seal, in particular a sealing film, and/or a sterilization film. In particular, the cover should prevent the escape of the food solution or prevent contamination.

Prior to the use of such a container, for example, during transport and/or storage of this container, a protective element (for example, a lid, or a cap or the like) can be placed on the discharge opening of the container and connected to the container to maintain the integrity of the cover and thus the sterilization of the nutritional solution.

In order to administer the nutritional solution, the container is usually connected to, for example, a drip chamber in such a way that a flow of the nutritional solution is made possible. The drip chamber is used to regulate dripping of the administered nutritional solution and prevents the formation of air bubbles. The connection between the container and the drip chamber is effected by a hollow discharge tap, which is used for fluid delivery from the container to the drip chamber.

According to the known prior art, the cover of the container is pierced by the discharge tap, thus enabling the escape of the nutritional solution. Usually, the cover is pierced by a pointed end of the discharge tap, which simplifies the tearing open of the cover.

Because of the relatively small dimensions of the opening pierced by the discharge tap, the flow of the solution between container and drip chamber is at least partially difficult, in particular when the nutrient solution to be administered has a higher, sometimes considerably higher, viscosity than water (dynamic viscosity of water at 20° C. of 1.0087 mPa s).

Based on this known prior art, the object of the invention is to ensure a more efficient flow of the nutritional solution between container and the drip chamber by means of a discharge tap. This object is achieved at least in part by a cap according to claim 1 and/or by a sealing element according to claim 11. Preferred embodiments of the invention are the subject of the respective subclaims.

Accordingly, the present invention relates to a discharge cap, in particular for a container for accommodating an enteral nutritional solution. As described above, such a container has a discharge opening which is sealed liquid-tight with a cover and has a projection for the arrangement of the discharge cap in the region of the discharge opening. In particular, the projection is a region of the container, in particular a region of the container neck and/or the boundary of the discharge opening.

The discharge cap can be arranged with an open front end over the discharge opening of the container and has at least one receiving opening for a discharge tap on the side of the discharge cap facing away from the open front end. In the following, the side of the discharge cap facing away from the open front end is referred to as the "opposite side".

The discharge cap has at least one sealing body, which is arranged in the region of the open front end of the discharge cap, that is, in the open lumen of the discharge cap. In particular, the sealing body is substantially hollow circular and can thus have a center point. For example, the sealing body is a seal. In particular, the sealing body ensures a liquid-tight connection between the discharge cap and the container.

In the assembled state of the discharge cap with the container, the discharge cap is in particular arranged in the region of the discharge opening of the container and in contact with the projection of the container. In particular, the discharge cap is connected and/or fastened to the projection. In addition, for example, the discharge cap sits on the discharge opening of the container and/or covers the discharge opening at least partially.

In the assembled state of the discharge cap with the container, for example, the sealing body is arranged between the opposite side of the discharge cap and the cover of the container. In particular, the sealing body is arranged in the immediate vicinity of this side of the discharge cap and the cover. In the assembled state of the discharge cap with the container, for example, the sealing body can be at least partially in contact with the opposite side of the discharge cap and with the cover.

The discharge cap has a tear-open aid, which is arranged below the receiving opening for the discharge tap and in the region of the open front end, for example, in the open lumen of the discharge cap. In particular, the tear-open aid is arranged between the receiving opening and the open front end.

The tear-open aid is moved in the direction of the open front end when inserting the discharge tap. In particular, the tear-open aid can be a fin, a disk, and/or a plate. For example, the tear-open aid is formed substantially flat. The movement of the tear-open aid generated by the introduction of the discharge tap can also be referred to below as a "tear-open aid movement".

In particular, when the discharge cap is in the assembled state with the container, the tear-open aid comes into contact with the cover of the container during the tear-open aid movement and thus tears open the cover.

The tear-open aid thus makes it possible to pierce an opening for the flow of enteral food solution, this opening being larger than an opening generated by the discharge tap. The flow of the nutritional solution between the container and the drip chamber is thus simplified and/or stabilized. The shape and/or the cross section of the tear-open aid can in particular substantially correspond to the desired shape of the opening generated by the tear-open aid.

In the assembled state, the discharge cap and the discharge tap form a coupling element which connects the container to a drip chamber. In particular, the open front end of the discharge cap is connected to the container while the discharge tap is introduced into the receiving opening and is flow-connected to the drip chamber to allow fluid delivery from the container to the drip chamber.

In the assembled state of the discharge cap with the container, the discharge cap can be connected to the projection of the container by a frictional connection and/or a positive connection and/or a material connection.

In one embodiment of the invention, for example, a screw thread is arranged in the region of the open front end of the discharge cap. In particular, the projection of the container has a corresponding screw thread, engages in the assembled state of the discharge cap with the container, the screw thread of the discharge cap in the screw thread of the projection and thus forms a screw connection between the discharge cap and the container.

In particular, the discharge cap can be a strap closure, wherein, for example, the strap of the discharge cap can be anchored in two opposite recesses of the container. In addition, the discharge cap can be a crown cap or a crossover plug and form a positive connection in the assembled state with the boundary of the container. In this case, therefore, the boundary of the container serves as a projection.

The discharge cap can, for example, have a clamping ring which is arranged in particular in the region of the open front end. In the assembled state of the discharge cap with the container, the clamping ring clamps, for example, the projection and thus forms a frictional connection between the discharge cap and the container.

The discharge cap is fastened by the above-mentioned frictional connection, positive connection and/or material connection to the projection of the container and can serve as a protective element for the cover before the use of the container (for example, during transport and/or storage of the container).

According to one embodiment of the discharge cap according to the invention, the receiving opening for the discharge tap is a guide aid, which determines the orientation of the discharge tap, in particular by means of a cross-sectional shape. Preferably, the cross-sectional shape does not have a rotational symmetry and in particular is not substantially circular. For example, the cross-sectional shape is a cross, an oval, a rectangle, a star, or the like.

The guide aid limits the connection possibilities between the discharge cap and the discharge tap, that is, the possibilities according to which the discharge tap can be introduced into the receiving opening. This simplifies the assembly of the discharge tap with the discharge cap, since possible sources of error in the assembly are substantially reduced.

In addition, the guide aid ensures that the discharge tap, in particular the pointed end thereof, is arranged correctly positioned with respect to the tear-open aid, which optimizes the tear-open aid movement of the tear-open aid and thus the tearing open of the cover of the container.

An embodiment of the discharge cap according to the invention has a ventilation opening on the opposite side of the discharge cap, which allows, for example, the ventilation in the container. This ventilation compensates for the pressure between the inside and outside of the container and thus facilitates the drainage of the nutritional solution from the container through the discharge tap.

In a further embodiment of the invention, the tear-open aid is integrally formed with the sealing body. In this case, the tear-open aid and the sealing body in particular form a sealing element, since the tear-open aid and the sealing body are connected to one another.

This opposing arrangement of the tear-open aid and the sealing body reduces the complexity of the production of the discharge cap according to the invention, which leads, among other things, to material savings and/or cost reduction. In fact, the tear-open aid and the sealing body should not be manufactured separately and independently of one another and then put on, rather they can be manufactured in one piece, for example, by a relatively simple plastic injection molding process.

In one embodiment of the discharge cap according to the present invention, the tear-open aid is pivotably arranged on the sealing body and thus forms in particular a sealing element.

In particular, in this case, the tear-open movement of the tear-open aid is a pivoting movement. After breakthrough of the cover, the tear-open aid pivots with respect to the opening arranged on the cover and thus does not obstruct this opening, which further enhances the flow of the nutritional solution between the container and the drip chamber through the discharge tap.

According to one embodiment of the invention, the tear-open aid extends radially in the direction of the center point and/or the center of gravity of the sealing body. In this case, the sealing body can be arranged in the assembled state with the container and thus the tear-open aid in the immediate vicinity of the cover and in particular in contact with the cover. The tear-open aid thus tears open the cover at the beginning of tear-open movement and the breakthrough of the cover resulting therefrom is thus simplified and improved.

The tear-open aid of an embodiment of the discharge cap according to the invention is formed sharp-edged on the outer contour. Such an outer contour makes it possible to achieve an opening arranged on the cover with clean cut edges and thus to at least partially convey the shape of this opening by means of the tear-open aid. In addition, the tear-open aid having a sharp-edged outer contour increases the reliability of the breakthrough of the cover, since the sharp-edged outer contour reduces the frequency of occurrence of the incomplete cut lines generated by the tear-open aid.

In particular, the tear-open aid can have at least one tip in the direction of the center point and/or the center of gravity of the sealing body. For example, the tear-open aid can have two tips and in particular the shape of a split tongue. In addition, the tear-open aid can have a plurality of tips and/or at least be annular.

This tip simplifies the breakthrough of the cover and reduces the necessary force which must act through the tear-open aid to pierce the opening arranged on the cover. The tearing open of the cover of the container is thus facilitated.

In one embodiment of the discharge cap, the tear-open aid and the sealing body are connected to one another by means of a web region, and in particular the tear-open aid and the sealing body form a sealing element which has the web region. In particular, the web region increases the pivoting flexibility of the tear-open aid with respect to the sealing body.

When the tear-open aid is integrally formed with the sealing body, the web region in particular can be a groove which is arranged, for example, between the tear-open aid and the sealing body and/or integrally formed with the sealing body and the tear-open by, for example, a plastic injection molding process. When, for example, the tear-open aid and the sealing body are connected to one another by a material connection, the web region can be and/or have the weld seam between the tear-open aid and the sealing body.

In particular, the web region can be formed by two opposing grooves. These grooves can be arranged between the tear-open aid and the sealing body and/or be formed integrally with the sealing body and the tear-open aid by, for example, a plastic injection molding process.

According to one embodiment of the discharge cap according to the invention, the receiving opening is formed by a receiving opening shell which extends, for example, substantially along a receiving opening direction. When the discharge tap is introduced into the receiving opening, the discharge tap in particular is arranged substantially along the receiving opening direction.

The receiving opening shell can have a screw thread. When, for example, the discharge tap has a union nut having a corresponding screw thread, the screw thread of the receiving opening shell engages in the screw thread of the union nut in the assembled state of the discharge cap with the discharge tap and thus forms a screw connection between the discharge cap and the discharge tap, which at least partially reinforces the assembly of the discharge tap with the discharge cap.

In one embodiment of the invention, the tear-open aid is made of at least a first material, wherein the first material is selected from a material group.

In particular, the material group comprises duroplastic and thermoplastic polymers and in particular polyphenylene sulfide, polypropylene, poly-1-butene, polyvinyl chloride, polyvinylidene chloride, polymethyl methacrylate, polyacrylonitrile, polystyrene, polysulfone, polyacetal, polyvinyl alcohol, polyvinyl acetate, ionomers, fluoroplastic, polyethylene, polyamide, in particular a partially aromatic polyamide, polycarbonate, polyester, polyphenylene oxide, polysulfone, polyvinyl acetal, polyurethane, and chlorinated polyether, cellulose nitrate, cellulose acetate, cellulose ether, phenolic resin, urea resin, thiourea resin, melamine resin, alkyl resin, allyl resin, silicone, polyimide, polybenzimidazole, epoxy resin, casein plastic, crosslinked polyurethane, unsaturated polyester resin, combinations thereof and the like.

The sealing body can, but need not, be made of the first material so that the sealing body and the tear-open aid consist of the same material. In addition, the sealing body can consist of a second material, which can, for example, be selected from the above-mentioned material group.

In a further embodiment of the invention, the tear-open aid and/or the sealing body are fixedly connected to the opposite side of the discharge cap, for example, the tear-open aid or the sealing body are connected to this side such that the tear-open aid cannot move along a direction extending substantially parallel to the opposite side. In particular, the tear-open aid and/or the sealing body are connected non-rotatably with respect to a direction which is substantially perpendicular to the opposite side. This fixed connection ensures, among other things, the correct arrangement between the tear-open aid and the receiving opening and thus the optimal tear-open movement In particular, the sealing body and/or the tear-open aid are fixedly connected to the opposite side by, for example, a frictional, positive and/or material connection. For example, the sealing body and/or the tear-open aid are connected to the opposite side by a latching connection and/or a tongue and groove connection and/or a snap-in connection and/or an adhesive connection.

The invention also relates to a sealing element for a discharge cap, in particular for the discharge cap according to the invention, which sealing element has a hollow circular-shaped sealing body and at least one tear-open aid. The tear-open aid is arranged in an interior segment to the center point and/or center of gravity of the sealing body and extends at least in sections in the direction of the center point or the center of gravity of the sealing body.

When the sealing element is integrated into a discharge cap, in particular in the discharge cap according to the invention, the sealing body and thus the tear-open aid can be arranged in the immediate vicinity of the cover and in particular in contact therewith in the assembled state with the container. The tear-open aid thus tears open the cover at the beginning of tear-open movement and the breakthrough of the cover resulting therefrom is thus simplified and improved.

According to one embodiment of the sealing element according to the invention, the tear-open aid is pivotally arranged on the sealing body.

When the sealing element is integrated into a discharge cap, in particular in the discharge cap according to the invention, the tear-open aid pivots after breakthrough of the cover in relation to the opening arranged on the cover and thus does not obstruct this opening. This improves the flow of nutritional solution between the container and the drip chamber through the discharge tap.

The tear-open aid of an embodiment of the sealing element according to the invention is formed sharp-edged on the outer contour. Such an outer contour makes it possible to achieve an opening arranged on the cover with clean cut edges and thus to at least partially convey the shape of this opening by means of the tear-open aid. In addition, the tear-open aid having a sharp-edged outer contour increases the reliability of the breakthrough of the cover, since the sharp-edged outer contour reduces the frequency of occurrence of the incomplete cut lines generated by the tear-open aid.

In particular, the sealing element has at least one tip in the direction of the center point and/or the center of gravity of the sealing body. This tip simplifies the breakthrough of the cover and reduces the necessary force which must act through the tear-open aid to pierce the opening arranged on the cover. The tearing open of the cover of the container is thus facilitated.

Figure 2:
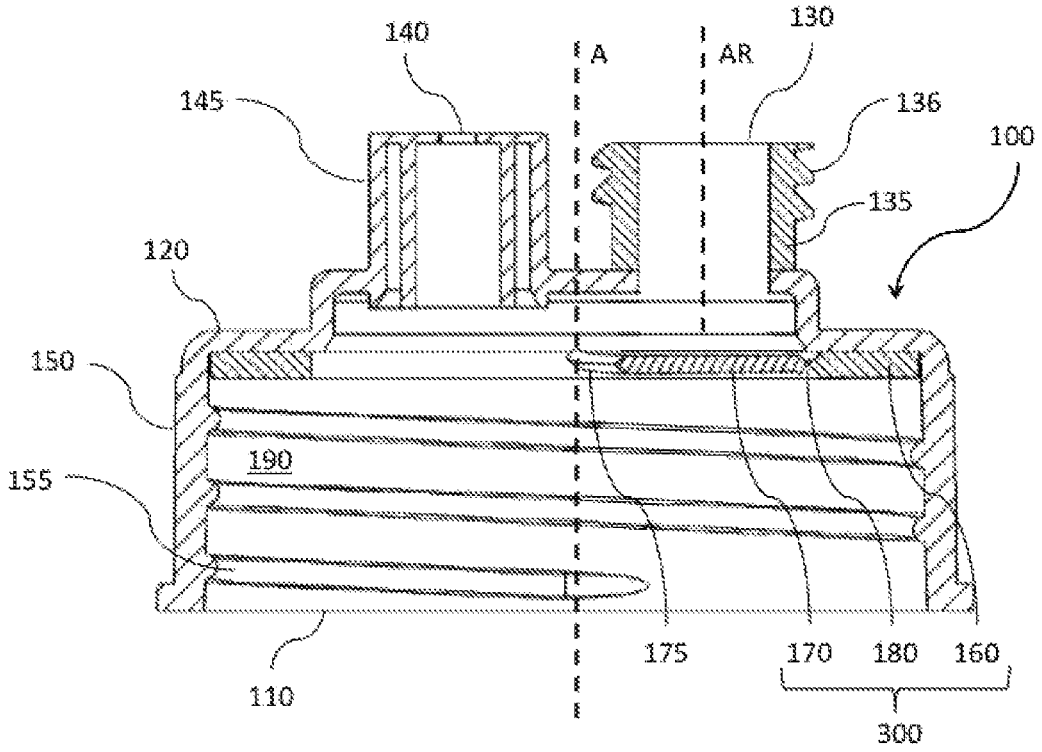
Figure 3A:
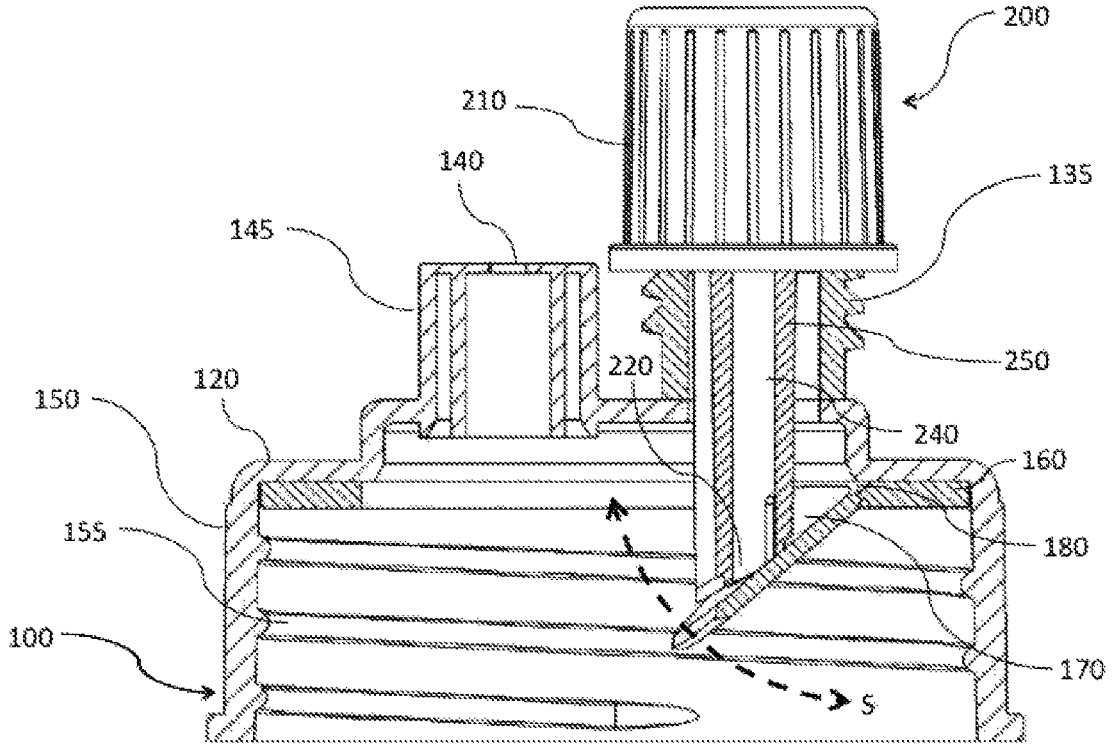
Figure 3B:
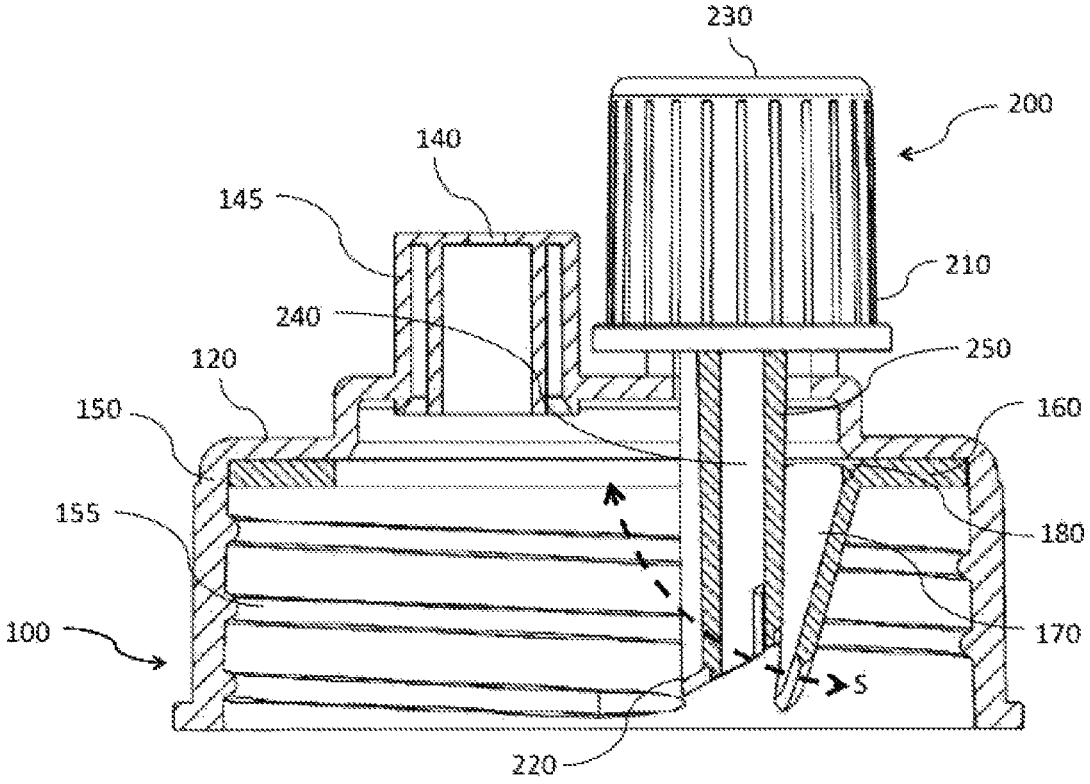
Figure 4:
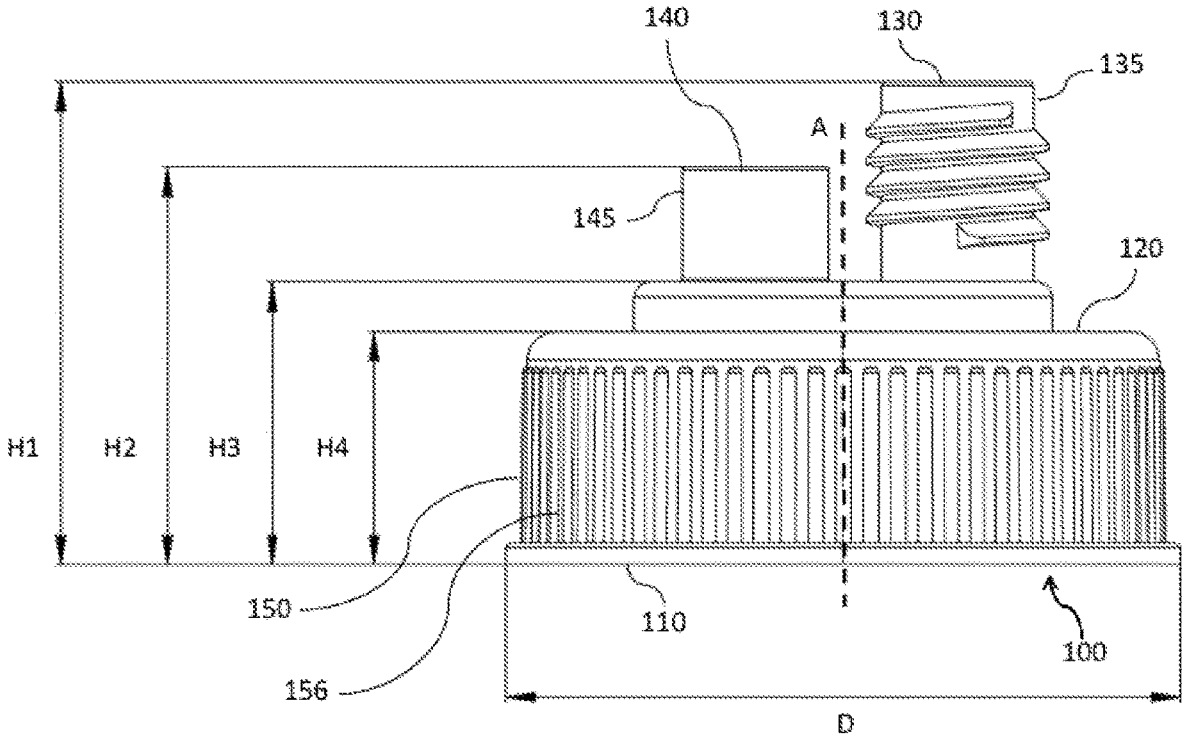

Various embodiments of the invention are explained hereinafter, which illustrate the invention by way of example only and do not represent a limitation of the general inventive concept with respect to modifications. Shown are:

FIG. 1 a schematic longitudinal section of a first embodiment of the discharge cap according to the invention;

FIG. 2 a schematic longitudinal section of a second embodiment of the discharge cap according to the invention;

FIG. 3*a* a schematic longitudinal section of the second embodiment of the discharge cap according to the invention, which is assembled in a first state with a discharge tap;

FIG. 3*b* a schematic longitudinal section of the second embodiment of the discharge cap according to the invention, which is assembled in a second state with the discharge tap; and FIG. 4 a schematic side view of a third embodiment of the discharge cap according to the invention.

FIG. 1 shows a schematic longitudinal section of a first embodiment of the discharge cap 100. In particular, the discharge cap 100 is a discharge cap 100 for a container (not illustrated) for receiving an enteral nutritional solution. Such a container has in particular a discharge opening, which is sealed liquid-tight with a cover and has a projection for the arrangement of the discharge cap in the region of the discharge opening.

The discharge cap 100 has a side shell 150, which can have a rotational symmetry about an axis of symmetry A. The side shell 150 forms an open lumen 190 and the open front end 110, which is substantially circular and substantially perpendicular to the axis of symmetry A. The discharge cap 100 can be arranged with the open front end 110 above the discharge opening of the container (not illustrated).

In the region of the open front end 110, the side shell 150 has a screw thread 155 which is arranged on the interior surface of the side shell 150. This screw thread 155 in the assembled state of the discharge cap with the container (not illustrated) can engage a corresponding screw thread of the container and thus can form a screw connection between the discharge cap 100 and the container (not illustrated).

The opposite side 120 is facing away from the open front end 110 and extends substantially perpendicular to the axis of symmetry A. The opposite side 120 has the receiving opening 130 for a discharge tap (not illustrated). In particular, the receiving opening 130 is substantially perpendicular to a first direction R1, wherein the first direction R1 is substantially parallel to the axis of symmetry A. In particular, the receiving opening 130 is arranged on a stepped region 125 of the opposite side 120. In particular, the receiving opening 130 can be a guide, which determines the orientation of the discharge tap, in particular by means of a cross-shaped cross section.

The opposite side 120 can also have the ventilation opening 140, which is formed by a ventilation opening shell 145. In particular, the ventilation opening shell 145 extends outwardly with respect to the open lumen 190 along a second direction R2, which is substantially parallel to the axis of symmetry A. In addition, the ventilation opening shell 145 forms an interior region 195 of the open lumen 190. For example, the ventilation opening shell 145 and the ventilation opening 140 are arranged on the step-shaped region 125.

The discharge cap 100 has the sealing body 160, which is formed in a substantially hollow circular shape. The sealing body 160 can, for example, be a seal and thus can have a center point (not illustrated). The tear-open aid 170 is connected to the sealing body 160 by means of the web region 180 and is arranged pivotably on the sealing body 160 about the web region 180. The tear-open aid 170 is arranged in a first position with respect to the sealing body 160, in particular in an interior segment to the center point of the sealing body 160 and extends at least in sections in the direction of the center point of the sealing body 160 and substantially perpendicular to the axis of symmetry A. In particular, the tear-open aid 170 can be a fin, which, for example, has at least one tip 175. For example, the tear-open aid 170 has at least two tips 175 and/or the shape of a split tongue.

The tear-open aid 170 and the sealing body 160 thus form an embodiment of the sealing element 300 according to the invention, which has the web region 180. In particular, the tear-open aid is integrally formed with the sealing body, for example, by a plastic injection molding process.

In this case, for example, the web region 180 can be formed by two opposing grooves 181, 182. In addition, and in particular, the web region 180 is arranged between the tear-open aid 170 and the sealing body 160 and is integrally formed with the sealing body 160 and the tear-open aid 170, for example, by a plastic injection molding process.

The sealing body 160 is arranged in the region of the open front end 110 and is in contact with the opposite side 120 and with the side shell 150. In addition, the tear-open aid 170 is arranged below the receiving opening 130 for the discharge tap 200 and in the region of the open front end 110. When inserting the discharge tap 200 into the receiving opening 130, the tear-open aid 170 is movable in the direction of the open front end, for example, from the first position to a second position.

The sealing body 160 and thus the tear-open aid 170 can be fixedly connected to the opposite side 120 by, for example, a frictional, positive connection and/or material connection. For example, the sealing body 160 is connected to the opposite side 120 by a latching connection and/or a tongue and groove connection and/or a snap-in connection and/or an adhesive connection.

In particular, the sealing body 160 and the tear-open aid 170 are non-rotatably connected with respect to the axis of symmetry A, that is, they cannot rotate about the axis of symmetry A. In addition, the sealing body 160 can move along the radial directions R3, R4 with respect to the axis of symmetry A, since the side shell 150 substantially prevents such linear movements.

FIG. 2 illustrates a schematic longitudinal section of a second embodiment of the discharge cap 100. This embodiment and the first embodiment of the discharge cap 100 differ in the shape of the receiving opening 130 for a discharge tap (not illustrated).

According to the second embodiment of the discharge cap 100, the receiving opening 130 arranged on the opposite side 120 is formed by a receiving opening shell 135. The receiving opening shell 135 extends outwardly with respect to the open lumen 190 along the receiving opening direction AR, which is substantially parallel to the axis of symmetry A. For example, the receiving opening shell 135 and the receiving opening 130 are arranged on the stepped region 125 of the opposite side 120.

The receiving opening shell 135 has a screw thread 136. As illustrated in FIG. 3*a* and FIG. 3*b*, this screw thread 136 can engage in the assembled state of the discharge cap with a discharge tap 200 in a corresponding screw thread of the union nut 210 of the discharge tap 200 and thus form a screw connection between the discharge cap 100 and the discharge tap 200.

FIGS. 3*a* and 3*b* show a schematic longitudinal section of the second embodiment of the discharge cap 100, which is assembled in a first or second state with a discharge tap 200.

In particular, the discharge tap 200 has a hollow region 240, which is delimited by a discharge tap shell 250, an open pointed end 220 and front opening 230 arranged on the opposite side of the pointed end 220. In particular, a fluid connector (not illustrated) flow-connected to a drip chamber can be introduced into the front opening 230 to allow, for example, a flow of the nutritional solution between the container (not illustrated) connected to the discharge cap 100 and the drip chamber. In this case, for example, the front opening 230 can have a standardized shape and/or the fluid connector can be a tube.

In addition, the discharge tap 200 has a union nut 210 having a screw thread (not illustrated) arranged on the interior surface of the union nut 210. The screw thread of the union nut 210 can engage the screw thread 136 of the discharge cap 100 in the assembled state of the discharge cap 100 with the discharge tap 200, and thus form a screw connection between the discharge cap 100 and the discharge tap 200.

In the first and second assembled state of the discharge cap 100 with the discharge tap 200, the union nut 210 is partially or completely screwed onto the receiving opening shell 135 to form the above-mentioned screw connection between the discharge cap 100 and the discharge tap 200. The discharge tap 200 is thus introduced into the receiving opening 130 and arranged along the receiving opening direction AR. In addition, in the first and/or in the second assembled state of the discharge cap 100 with the discharge tap 200, the open pointed end 220 of the discharge tap 200 is in contact with the tear-open aid 170.

The insertion of the discharge tap 200 into the receiving opening 130 generates the tear-open aid movement from the first position to a third position (see FIG. 3*b*) via a second position (see FIG. 3*a*). In particular, the tear-open aid movement is a pivotal movement S about the web region 180.

In particular, when the discharge cap 100 is located in the assembled state with the container (not illustrated), the tear-open aid 170 comes into contact with the cover of the container during the tear-open aid movement and consequently tears open the cover. The tear-open aid 170 thus allows the piercing of an opening for the flow of enteral nutritional solution.

FIG. 4 shows a schematic side view of a third embodiment of the discharge cap 100 according to the invention. In particular, this embodiment has the features described above of the second embodiment of the discharge cap 100 according to the invention illustrated in FIG. 2, FIG. 3*a* and FIG. 3*b*.

In addition, and in particular, the discharge cap 100 can have a plurality of grooves 156 arranged on the exterior surface of the side shell 150 and extending substantially parallel to the axis of symmetry A. The grooves 156 improve, among other things, the grip of the discharge cap 100 and thus simplify the unscrewing of the discharge cap 100 at the projection of the container.

By way of example, the discharge cap 100 has the following dimensions: diameter D of the side shell approx. 46.0 mm, height H4 of the side shell approx. 16.0 mm, total height H3 of the side shell and the opposite side 120 approx. 19.35 mm. The distance H2 between the open front end 110 and the ventilation opening 140 is, for example, approximately 27.2 mm and/or the distance H1 between the open front end 110 and the receiving opening 130 can be about 33.0 mm.

The invention claimed is:

1. A discharge cap suitable for use with a container for accommodating an enteral nutritional solution, the container having a discharge opening which is sealed liquid-tight with a cover and having a projection for arrangement of the discharge cap in a region of the discharge opening, the discharge cap comprising:

an open front end being able to be arranged above the discharge opening of the container and on an opposite side of the discharge cap facing away from the open front end having at least one receiving opening for a discharge tap and at least one sealing body being arranged in a region of the open front end of the discharge cap;

wherein a tear-open aid is arranged below the receiving opening for the discharge tap and in the region of the open front end, said tear-open aid is moved in the direction of the open front end during insertion of the discharge tap, and wherein the tear-open aid is arranged in an interior segment to the center point of the sealing body and extends at least in sections in the direction of the center point of the sealing body;

wherein the tear-open aid is integrally formed with the sealing body and is pivotally arranged on the sealing body; and wherein the sealing body is arranged in the immediate vicinity of the open front end of the discharge cap so that in the assembled state on the container, a first surface of the sealing body can be brought at least partially in contact with the side of the discharge cap facing away from the open front end and with the cover.

2. The discharge cap according to claim 1, wherein a screw thread is arranged in the region of the open front end of the discharge cap.

3. The discharge cap according to claim 1, wherein the receiving opening for the discharge tap is a guide aid which determines the alignment of the discharge tap by means of a cross-sectional shape.

4. The discharge cap according to claim 1, wherein the discharge cap has a ventilation opening on the side facing away from the open front end.

5. The discharge cap according to claim 1, wherein the tear-open aid extends radially in the direction of the center point of the sealing body.

6. The discharge cap according to claim 1, wherein the tear-open aid is formed sharp-edged on the outer contour and has at least one tip in the direction of the center point of the sealing body.

7. The discharge cap according to claim 1, wherein the tear-open aid and the sealing body are connected to one another by means of a web region.

8. The discharge cap according to claim 1, wherein the tear-open aid is made of at least one material selected from a group which comprises polyphenylene sulfide, polypropylene, poly-1-butene, polyvinyl chloride, polyvinylidene chloride, polymethyl methacrylate, polyacrylonitrile, polystyrene, polysulfone, polyacetal, polyvinyl alcohol, polyvinyl acetate, ionomers, fluoroplastic, polyethylene, polyamide, a partially aromatic polyamide, polycarbonate, polyester, polyphenylene oxide, polysulfone, polyvinyl acetal, polyurethane, and chlorinated polyether, cellulose nitrate, cellulose acetate, cellulose ether, phenolic resin, urea resin, thiourea resin, melamine resin, alkyl resin, allyl resin, silicone, polyimide, polybenzimidazole, epoxy resin, casein plastic, crosslinked polyurethane, unsaturated polyester resin, and combinations thereof.

9. A sealing element for the discharge cap according to claim 1, wherein the sealing element has a hollow circular-shaped sealing body and at least one feature serving as the tear-open aid, which is arranged in an interior segment to the center point of the sealing body and extends at least in sections in the direction of the center point of the sealing body.

10. The sealing element according to claim 9, wherein the tear-open aid is pivotably arranged on the sealing body.

11. The sealing element according to claim 9 wherein the tear-open aid is formed sharp-edged on the outer contour and has at least one tip in the direction of the center point of the sealing body.

12. The discharge cap according to claim 1, wherein the sealing body has a hollow circular shape and, in the assembled state on the container, a second surface of the sealing body contacts a portion of the cover of the container.

13. The sealing element according to claim 10, wherein the first surface of the sealing body can be brought at least partially in contact with the side of the discharge cap facing away from the open front end of the discharge cap and, in the assembled state on the container, a second surface of the sealing body contacts a portion of the cover of the container.

* * * * *